US007328812B2

(12) United States Patent
Nakao et al.

(10) Patent No.: US 7,328,812 B2
(45) Date of Patent: Feb. 12, 2008

(54) OVERHEAD TRAVELLING CARRIAGE

(75) Inventors: Takashi Nakao, Neyagawa (JP); Yoichi Nakamura, Nagaokakyo (JP)

(73) Assignee: Murata Kikai Kabushiki Kaisha, Kyoto-shi (JP)

( * ) Notice: Subject to any disclaimer, the term of this patent is extended or adjusted under 35 U.S.C. 154(b) by 26 days.

(21) Appl. No.: 11/159,120

(22) Filed: Jun. 23, 2005

(65) Prior Publication Data

US 2006/0169663 A1 Aug. 3, 2006

(30) Foreign Application Priority Data

Jun. 28, 2004 (JP) ..... 2004-189917

(51) Int. Cl.
*B66C 17/06* (2006.01)

(52) U.S. Cl. ..... 212/330; 414/940

(58) Field of Classification Search ..... 212/272, 212/100–105, 330–332; 414/940
See application file for complete search history.

(56) References Cited

U.S. PATENT DOCUMENTS

| | | | | |
|---|---|---|---|---|
| 622,830 | A * | 4/1899 | Temperley et al. | 212/98 |
| 1,166,035 | A * | 12/1915 | Arndt | 212/105 |
| 1,446,724 | A * | 2/1923 | Reilly | 212/105 |
| 2,620,075 | A * | 12/1952 | Hoyle et al. | 212/273 |
| 3,523,882 | A * | 8/1970 | Duclaux | 204/297.01 |
| 3,690,715 | A * | 9/1972 | Vanlingen et al. | 294/88 |
| 3,794,185 | A * | 2/1974 | Kroll et al. | 254/399 |
| 4,555,216 | A * | 11/1985 | Buschor | 414/728 |
| 4,663,114 | A * | 5/1987 | Cransac et al. | 376/271 |
| 5,145,227 | A * | 9/1992 | Monford, Jr. | 294/65.5 |
| 7,210,589 | B2 * | 5/2007 | Iizuka | 212/273 |

FOREIGN PATENT DOCUMENTS

| | | |
|---|---|---|
| GB | 1267178 A | 3/1972 |
| JP | 08-318882 | 12/1996 |
| JP | 09-077455 | 3/1997 |
| JP | 9-77455 | 3/1997 |
| JP | 09-077455 A | 3/1997 |
| JP | 10-167667 | 6/1998 |

OTHER PUBLICATIONS

Notifications for Reason(s) for Refusal of the Japanese Patent Application No. 2004-189917, with English translation.

* cited by examiner

*Primary Examiner*—Thomas J Brahan
(74) *Attorney, Agent, or Firm*—Westerman, Hattori, Daniels & Adrian, LLP.

(57) ABSTRACT

A centering member 20 is pressed downward using an elastic member 28; the centering member 20 is provided at the bottom of a platform 14. A plate 26 receiving an upper end of the elastic member 28 is positioned high while the platform 14 is elevating. The plate 26 is positioned low after the platform 14 has been completely elevated. While the platform 14 is elevating or lowering, a pressing force on the centering member 20 is reduced. After the platform 14 has been completely elevated, the pressing force is weakened. The present invention suppresses vibration of the platform having been completely elevated. The present invention also prevents the article from exerting a strong upward force on the platform via a pressing member when the article is loaded or unloaded.

6 Claims, 6 Drawing Sheets

OVERHEAD TRAVELLING CARRIAGE

FIELD OF THE INVENTION

The present invention relates to an overhead traveling carriage that conveys articles in a clean room, a library, a hospital, a common plant or warehouse. The present invention relates to prevention of vibration of articles conveyed while being chucked (gripped) by a platform.

BACKGROUND OF THE INVENTION

The Japanese Patent No. 2907077 describes an overhead travelling carriage having a centering member provided at the bottom of a platform. The centering member is abutted against the top of an article to be conveyed. This pressing force prevents vibration of the article being conveyed. To ensure that the vibration of the article is prevented, it is possible to increase the pressing force exerted by the centering member on the article. However, the inventor has found that an increase in pressing force on the centering member makes it difficult to grip or release the article using a chuck provided at the bottom of the platform.

FIG. 6 shows problems with the prior art. 8 is a flange of a cassette to be conveyed. 14 is a platform, 16 is a hanging member, and 18 is a chuck. 20 is a centering member and 24 is its shaft. 26 is a plate, and an elastic member 28 such as a coil spring is placed between the centering member 20 and the plate 26 to press the centering member 20 downward. Lowering the platform 14 first brings the centering member 20 into contact with a concave portion 9 of the flange 8. Then, to further lower the platform 14 so that the chuck 18 can support a bottom surface of the flange 8, it is necessary to cancel the weight of the platform 14 using a repulsive force exerted by the elastic member 28 on the platform 14, to further lower the platform 14. However, the platform 14 must be light in weight, so that the pressing force that can be exerted on the centering member 20 is limited. A similar problem occurs when an article is unloaded onto a load port. When the article lands on the load port, the spring force of the elastic member 28 urges the platform 14 upward. Thus, the platform 14 no longer lowers, thus making it difficult to remove the chuck 18 from the bottom surface of the flange 8. Accordingly, an increase in pressing force on the centering member 20 is likely to affect an operation of gripping or releasing the article.

SUMMARY OF THE INVENTION

It is a basic object of the present invention to reliably prevent an article from vibrating during for example, running of an overhead travelling carriage, while avoiding making it difficult to grip or release the article.

It is an additional object of an aspect of the present invention set forth in Claim 2 to provide a specific mechanism used to vary a pressing force on the article.

It is an additional object of an aspect of the present invention set forth in Claim 3 to enable a pressing force on a centering member to be automatically adjusted utilizing an elevating and lowering operation of a platform.

The present invention provides an overhead travelling carriage which conveys an article supported from below using chuck means provided on a platform, the overhead travelling carriage being characterized by comprising pressing means for pressing the article against the platform from above and adjusting means for adjusting a pressing force of the pressing means on the basis of a height position of the platform.

Preferably, the pressing means comprises a member which contacts the article from above, an elastic member which urges the contacting member downward, and receiving member which receives the other end of the elastic member and which can be displaced upward or downward with respect to the platform. Further, the adjusting means comprises means for displacing the receiving member upward or downward on the basis of the height position of the platform.

Particularly preferably, the adjusting means comprises means for displace the receiving member downward by contacting the overhead travelling carriage main body once the platform is elevated to its elevation end.

According to the present invention, the adjusting means is provided to adjust the pressing force exerted by the pressing means on the article on the basis of the height position. Thus, when the platform is elevated or lowered to grip or release the article, the pressing force can be weakened. Elevating the platform enables the pressing force to be increased. Accordingly, while for example, the overhead travelling carriage is running, the article can be sufficiently prevented from vibrating by increasing the pressing force that presses the article against the chuck means from above. Further, when the article is to be gripped or released, the pressing force is weakened to allow the platform to lower sufficiently. This allows the article to be easily gripped or released.

According to the aspect of the invention set forth in Claim 2, the member contacting the article from above is pressed downward using the elastic member. The receiving member receives the other end of the elastic member. The adjusting member displaces the receiving member downward on the basis of the height position of the platform. Thus, elevating the platform allows the receiving member to be displaced downward to increase the pressing force of the elastic member. On the other hand, lowering the platform allows the receiving member to be displaced upward to weaken the pressing force.

According to the aspect of the invention set forth in Claim 2, the means is provided which contacts the overhead travelling carriage main body to displace the receiving member downward once the platform has elevated to its elevation end. This makes it possible to automatically displace the receiving member downward utilizing the elevation of the platform up to its elevation end.

DETAILED DESCRIPTION OF THE PREFERRED EMBODIMENTS

Figure 1:
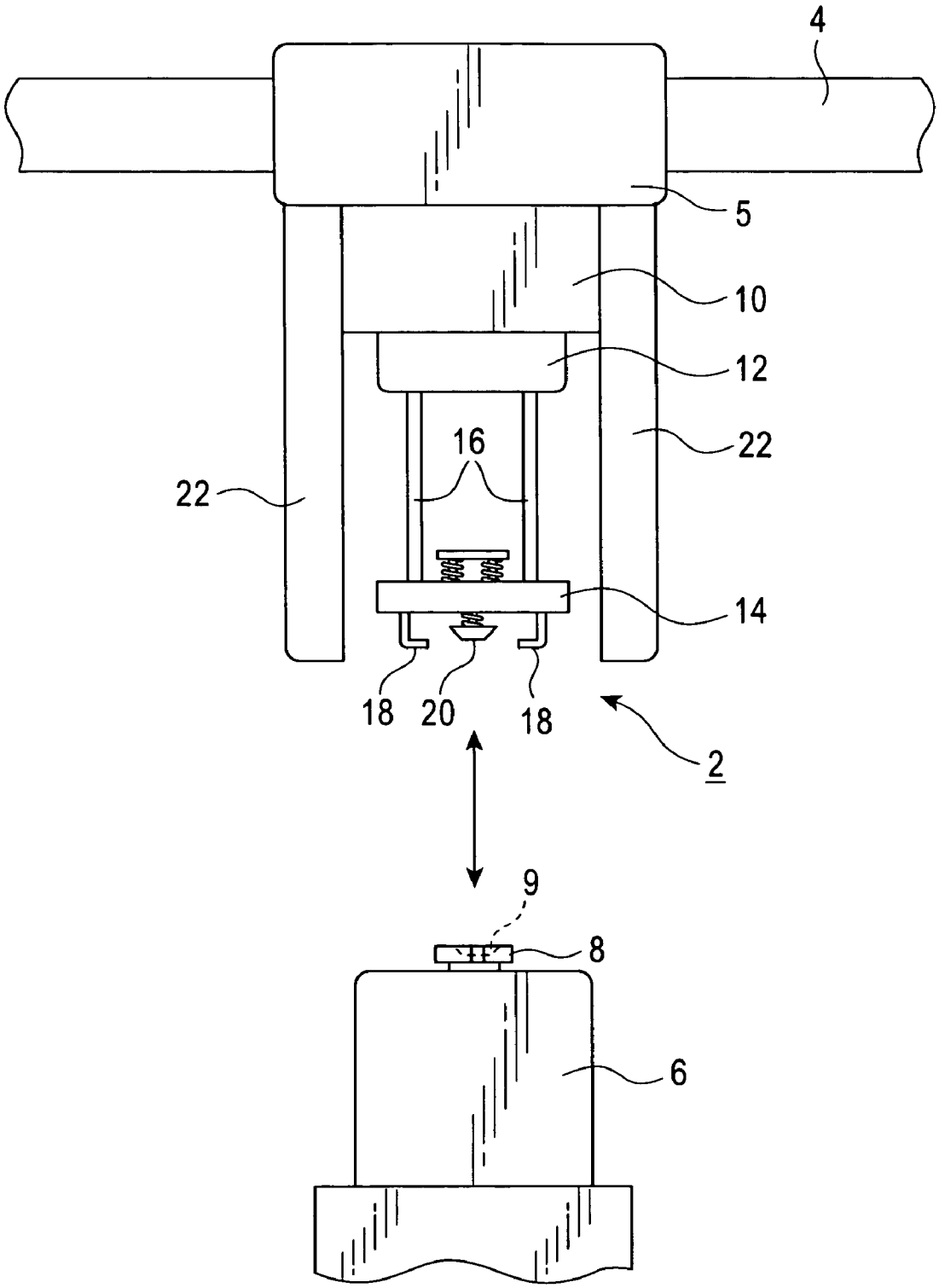
FIG. 1 is a side view of an overhead travelling carriage according to an embodiment.

An optimum embodiment of the present invention will be shown below.

FIGS. 1 to 5 shows the embodiment and its variation. In these figures, 2 is an overhead travelling carriage. 4 is a running rail provided, for example, near a ceiling of a clean room. 6 is a cassette as an example of a conveyed article, and the cassette 6 has a flange 8 at its top. The cassette 6 is conveyed while having its bottom surface gripped by a chuck 18 of the overhead travelling carriage 2, for example, from the opposite sides of the cassette 6. Further, a concave portion 9 is formed at the top of the flange 8. The type of the conveyed article, the structure of the chuck 18, and the like are arbitrary.

The overhead travelling carriage 2 is provided with a run driving portion 5 so as to run along the running rail 4. A lateral feeding portion 10 laterally moves an elevate and lower driving portion 12 perpendicularly to the running rail 4. The elevate and lower driving portion 12 is supported by the lateral feeding portion 10. A platform 14 is elevated or lowered by winding or feeding a hanging member 16 such as a belt or a wire. A lateral pair of the chucks 18 is provided on a bottom surface side of the platform 14. A centering member 20 is provided near the center of the bottom surface of the platform 14. In addition, the overhead travelling carriage 2 is provided with for example, a pair of fall preventing covers 22, 22 located in the front and rear of the overhead travelling carriage 2 in its running direction. When the cassette 6 is conveyed, it is prevented from falling by projecting fall preventing pawls or the like from the fall preventing covers.

Figure 2:
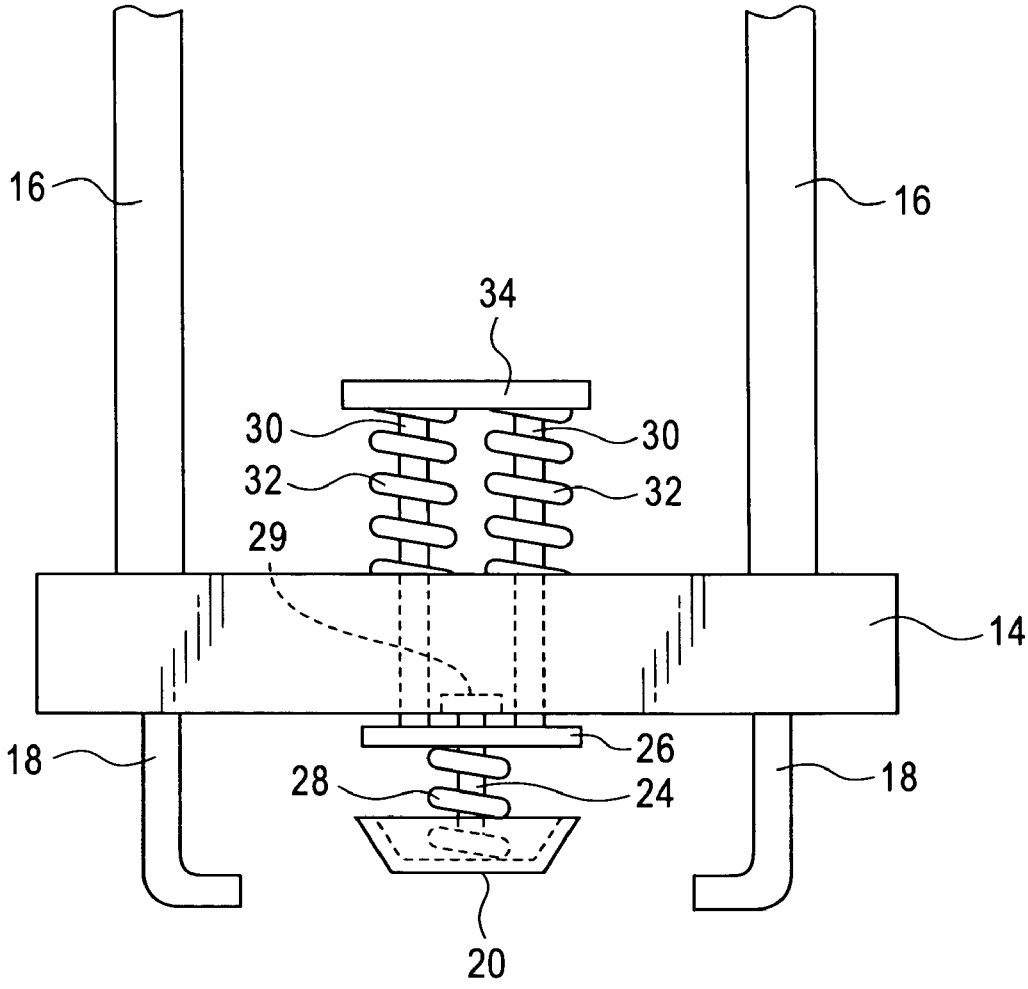
FIG. 2 is a side view of a platform according to the embodiment.

FIG. 2 shows the centering member 20 and its surrounding mechanisms. A bottom surface of the centering member 20 is shaped to engage with the concave portion 9, formed in the flange 8. 24 is a shaft of the centering member 20. 26 is a plate. An elastic member 28 such as a coil spring is provided between the plate 26 and a top surface of the centering member 20 to urge the centering member 20 downward. 29 is a head of the shaft 24 that prevents the shaft 24 from slipping off the plate 26. The plate 26 is provided with for example, a lateral pair of shafts 30, 30 extending upward. Upper ends of the shafts 30, 30 are fixed to a plate 34. An elastic member 32 such as a coil spring is provided around each of the shafts 30. A top surface of the platform 14 and the plate 34 receive the spring force of the elastic member 32. The shafts 30, 30 can be freely displaced upward or downward with respect to the platform 14. Accordingly, a plate 26 located at lower ends of the shafts 30, 30 can be freely displaced upward or downward with respect to the platform 14.

In FIG. 2, the spring force of the elastic member 32 places the plate 34 at a high position. Accordingly, the plate 26 has been elevated to the vicinity of the bottom surface of the platform 14. Then, displacing the plate 34 downward compresses the elastic member 32 to lower the plate 26. The elastic member 28 is similarly compressed, thus increasing the pressing force of the centering member 20.

Figure 3:
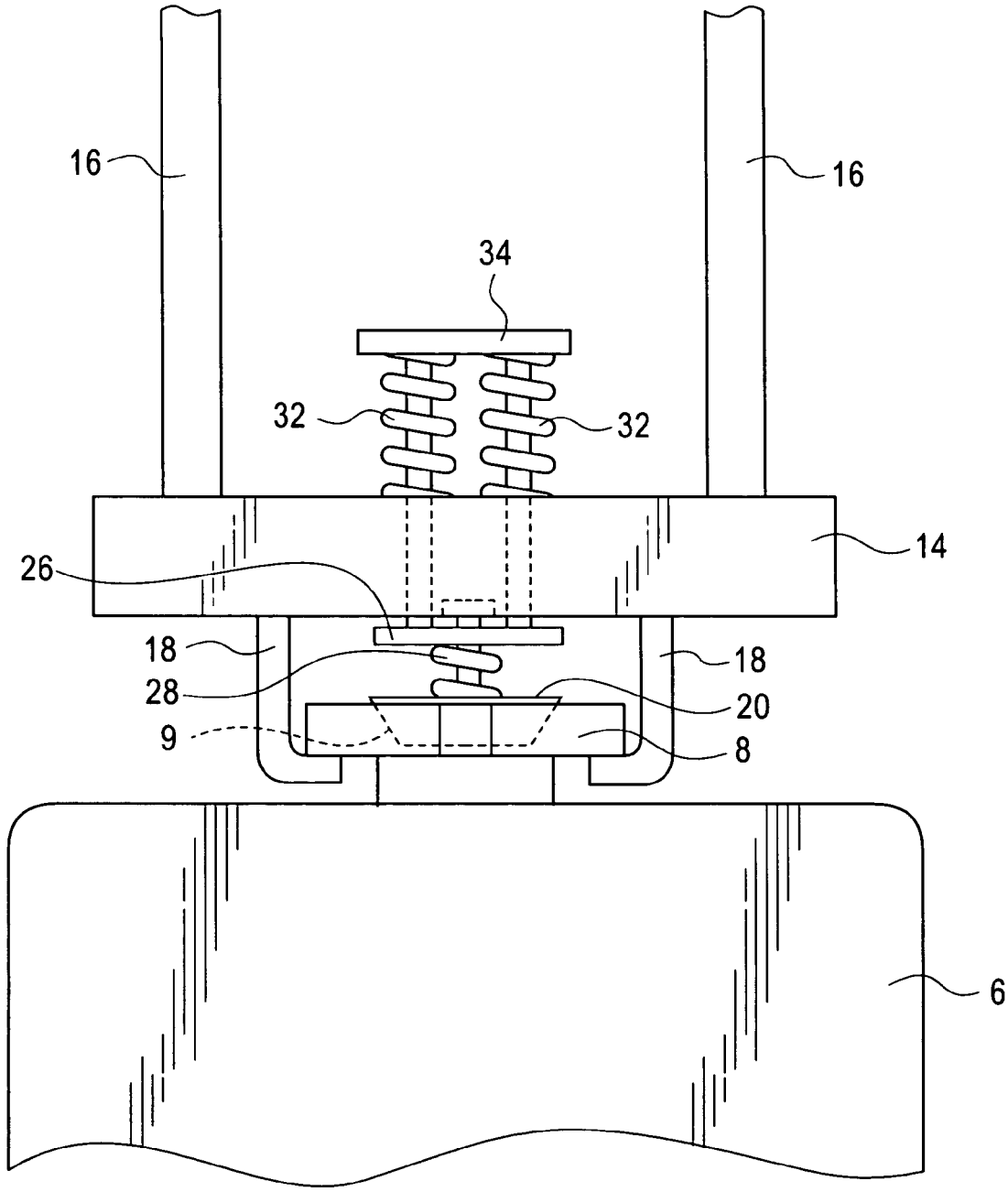
FIG. 3 is a side view of the platform that is elevating or lowering while gripping an article according to the embodiment.

FIG. 3 shows how the centering member 20 and its surroundings are positioned while the platform 14 is lowering. The plate 26 is placed at an elevated position. As a result, a relatively large gap is created between the centering member 20 and the plate 26 to reduce the pressing force of the elastic member 28. Thus, lowering the platform 14 makes it possible to reduce a pressing force exerted by the centering member 20 on the cassette 6 and a repulsive force received by the platform 14 from the centering member 20.

Figure 4:
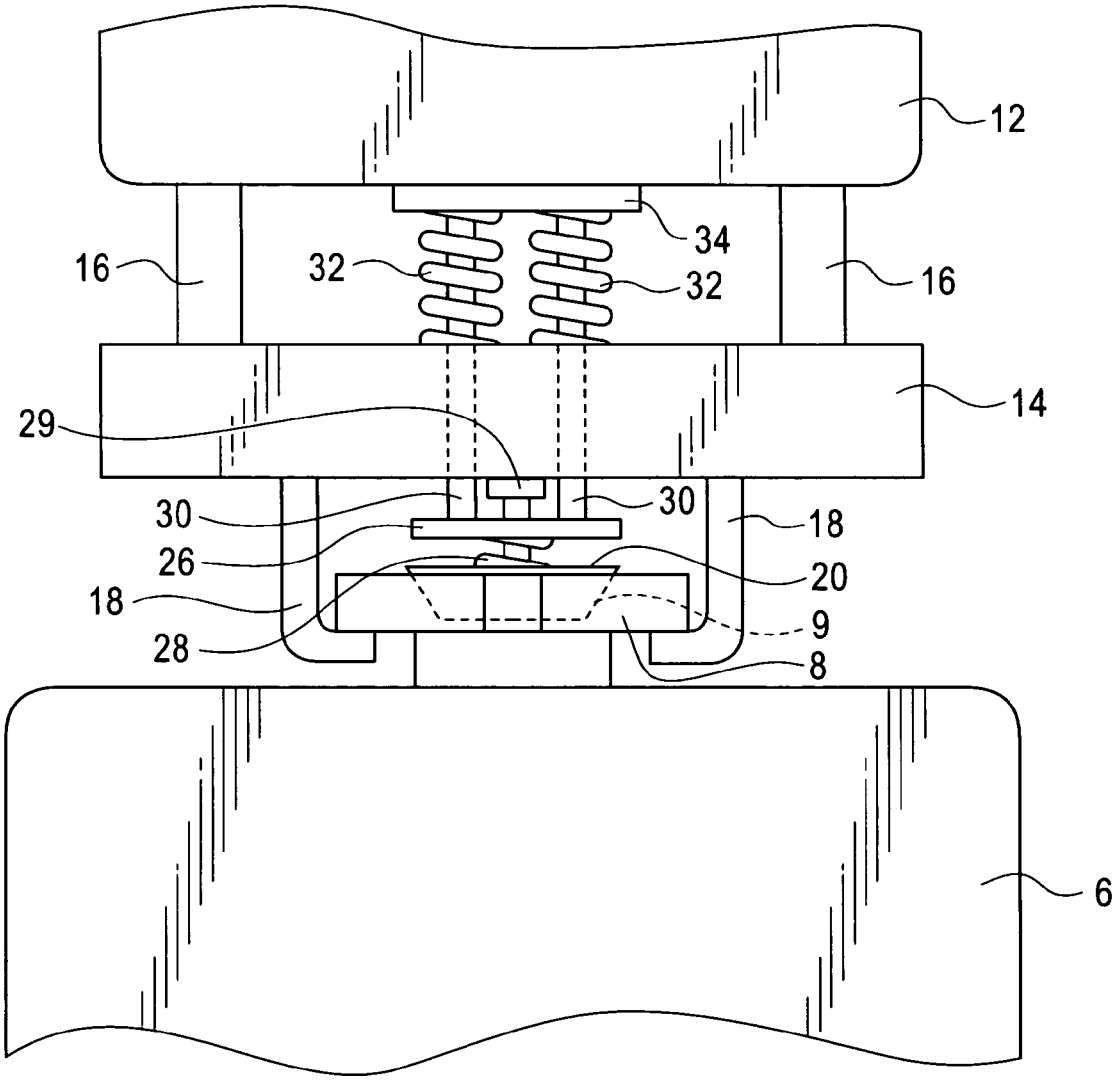
FIG. 4 is a side view of the platform gripping the article after being completely elevated.

FIG. 4 shows that the platform 14 has elevated to its elevation end. Once the platform 14 has elevated to its elevation end, for example, the plate 34 contacts a part of the overhead travelling carriage main body such as the lateral feeding portion 10 to compress the elastic member 32. The plate 26 is displaced downward with respect to the platform 14. As a result, the elastic member 28 is compressed to increase the downward pressure exerted by the centering member 20 on the concave portion 9. Consequently, the article 6 can be firmly gripped by the chucks 18. It is thus possible to prevent vibration that may result from running of the overhead travelling carriage 2 or lateral movement of the lateral feeding portion 10, by sandwiching the flange 8 between the chucks 18 and the centering member 20, and causing the elastic member 28 to forcefully press the centering member 20.

Figure 5:
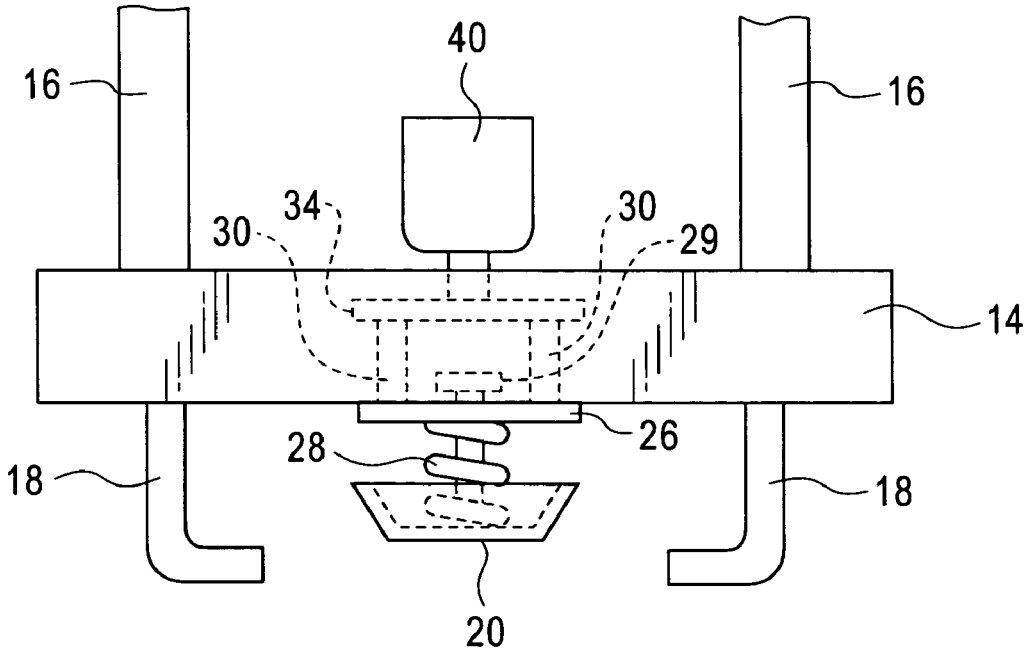
FIG. 5 is a side view of a platform according to a variation.
Figure 6:
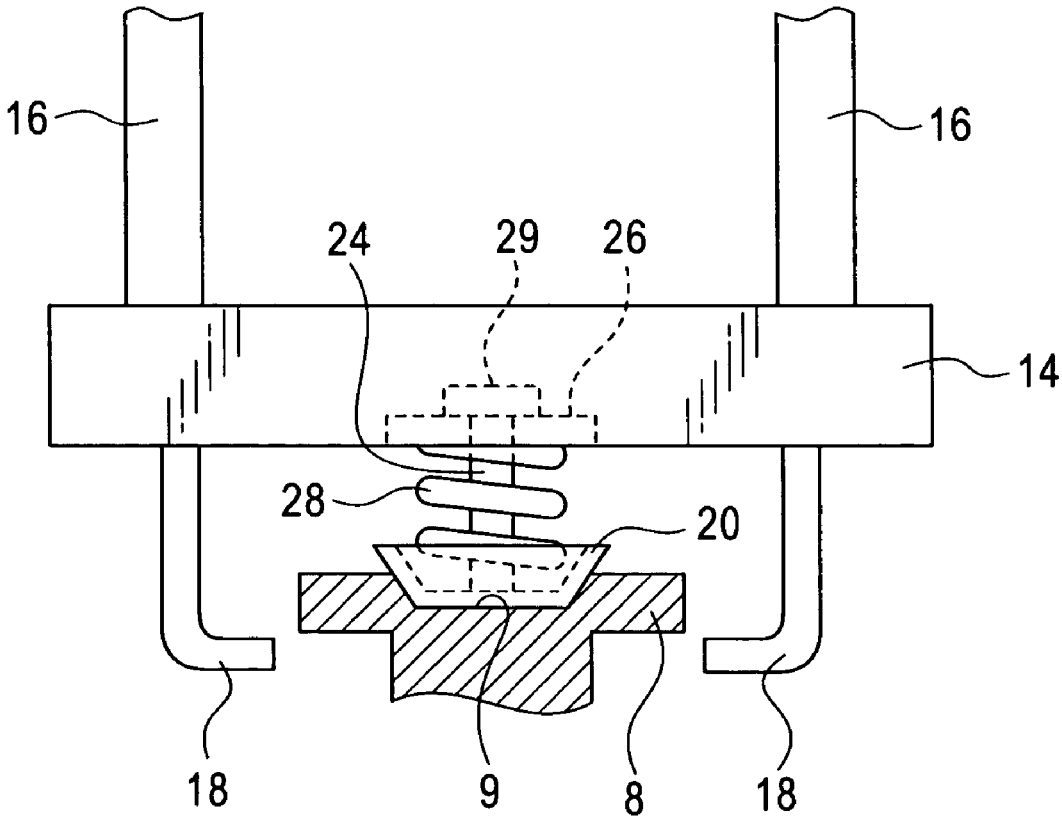
FIG. 6 PRIOR ART
FIG. 6 is a side view of a platform according to a conventional example.

FIG. 5 shows a variation using a cylinder 40 such as an air cylinder. The air cylinder 40 preferably provides low or medium pressures. The pressure exerted by the air cylinder 40 on the plate 34 is varied on the basis of the height position of the platform 14 to adjust the height position of the plate 26 and thus the pressing force on the centering member 20. In the variation shown in FIG. 5, the elastic member 32 need not be provided. In the variation shown in FIG. 5, even when the platform 14 is not located at its elevation end, the article 6 can be prevented from vibrating. For example, even while the platform 14 is elevating or lowering, the article 6 can be prevented from vibrating by using the air cylinder 40 to forcefully urge the centering member 20. To unload the article 6, it is possible to use the air cylinder 40 to urge the plate 34 until immediately before the bottom surface of the article 6 lands on the ground and then let the air out of the air cylinder 40 immediately before the landing. To load the article 6, it is possible to use the air cylinder 40 to urge plate 34 after an operation for chucking the article 6 has been completed. In an extreme case, the elastic member 28 may be omitted so that the centering member 20 is directly driven using the air cylinder 40. The pressing force of the air cylinder 40 may be adjusted by the height position of the platform 14, and the air cylinder 40 may be used as a kind of air spring.

The embodiment exerts the following effects.

(1) Before an article is gripped or released, the pressing force on the centering member 20 is reduced. Consequently, it is possible to prevent the repulsive force exerted by the elastic member 28 on the platform 14 from making a gripping or releasing operation difficult. As a result, the following two contradictory requirements can be met: prevention of vibration of the article by increasing the pressing force applied to the centering member 20 and a reduction in pressing force for allowing the article to be easily gripped or released.

(2) Once the platform 14 has been completely elevated, the pressing force exerted by the centering member 20 on the flange 8 can be increased by displacing the plate 34 downward. Thus, while the overhead travelling carriage 2 is running or is being laterally fed, the article 6 can be prevented from vibration by using the chucks 18 and the centering member 20 to reliably hold the article 6.

(3) In the embodiment shown in FIGS. 1 to 4, the pressing force on the centering member 20 can be adjusted by utilizing the operation of elevating or lowering the platform 14.

(4) The centering member 20 can be used to align the concave portion 9 of the flange 8 with the platform 14.

The invention claimed is:

1. An overhead travelling carriage comprising:

a chuck means provided on a platform, a pressing means for pressing an article against the chuck means from above, and a means for displacing said pressing means, wherein said pressing means comprises:

a contacting member which contacts the article from above, an elastic member, one end of which urges the contacting member downward, and a receiving member which receives the other end of the elastic member and which is displaced upward or downward with respect to the platform.

2. The overhead travelling carriage according to claim 1, wherein the means for displacing displaces the receiving member upward or downward on the basis of the height position of the platform.

3. The overhead travelling carriage according to claim 1, wherein the means for displacing displaces the receiving member downward by contacting the means for displacing with a main body of the overhead travelling carriage when the platform is elevated to its highest elevation.

4. An overhead traveling carriage comprising:

a platform, a chuck means, a centering member for centering an article contacted with said centering member, a first elastic member disposed between said centering means and a first plate, and a means for raising or lowering said first plate, wherein said means for raising or lowering said first plate includes a second elastic member disposed between said first plate and a second plate, wherein said first plate is displaced downward by contacting said second plate with a main body of the overhead travelling carriage when the platform is elevated to its highest elevation, and wherein said first and second elastic members are compressed when said platform is elevated to a highest position.

5. An overhead traveling carriage comprising:

a platform, a chuck means, a centering member for centering an article contacted with said centering member, a first elastic member disposed between said centering means and a first plate, and a means for raising or lowering said first plate, wherein said means for raising or lowering said first plate includes a cylinder to urge a second plate upwards or downwards, said second plate being connected to said first plate.

6. The overhead travelling carriage according to claim 5, wherein said cylinder urges said second plate upward or downward on the basis of the height position of the platform.

* * * * *